US005470054A

United States Patent [19]

Bohrman

[11] Patent Number: 5,470,054

[45] Date of Patent: Nov. 28, 1995

[54] ONE-PIECE EXTENSION ARM

[75] Inventor: Joseph K. Bohrman, Eagle, Wis.

[73] Assignee: Huffy Corporation, Waukesha, Wis.

[21] Appl. No.: 387,358

[22] Filed: Feb. 13, 1995

Related U.S. Application Data

[63] Continuation of Ser. No. 69,287, May 28, 1993, abandoned.

[51] Int. Cl.[6] ..... A63B 63/08

[52] U.S. Cl. ..... 273/1.5 R; 248/218.4; 248/230.5; 248/300

[58] Field of Search ..... 248/218.4, 230, 248/300; 211/195, 193; 273/1.5 R, 1.5 A

[56] References Cited

U.S. PATENT DOCUMENTS

| | | | |
|---|---|---|---|
| 1,978,033 | 10/1934 | Suppes | 248/230 X |
| 3,002,666 | 10/1961 | Silverman | 248/300 |
| 3,031,162 | 4/1962 | Whorton | 248/300 |
| 3,094,220 | 6/1963 | Harling | 248/230 X |
| 3,326,503 | 6/1967 | Bade | 248/300 X |
| 3,385,545 | 5/1968 | Patton | 248/230 X |
| 3,801,731 | 4/1974 | Hansen | 248/230 X |
| 4,648,517 | 3/1987 | Schafer | 211/195 X |
| 4,653,646 | 3/1987 | Allen et al. | 273/1.5 R |

*Primary Examiner*—Blair M. Johnson

*Attorney, Agent, or Firm*—Howrey & Simon; Richard S. Meyer

[57] ABSTRACT

A one-piece extension arm for connecting a basketball backboard to a support pole including a central web portion, a pair of spaced legs, a pair of forward projections and a pair of rearward projections such that the extension arm is symmetrical about a plane that bisects and is perpendicular to the central web portion and a one-piece planar blank from which the extension arm is formed.

20 Claims, 2 Drawing Sheets

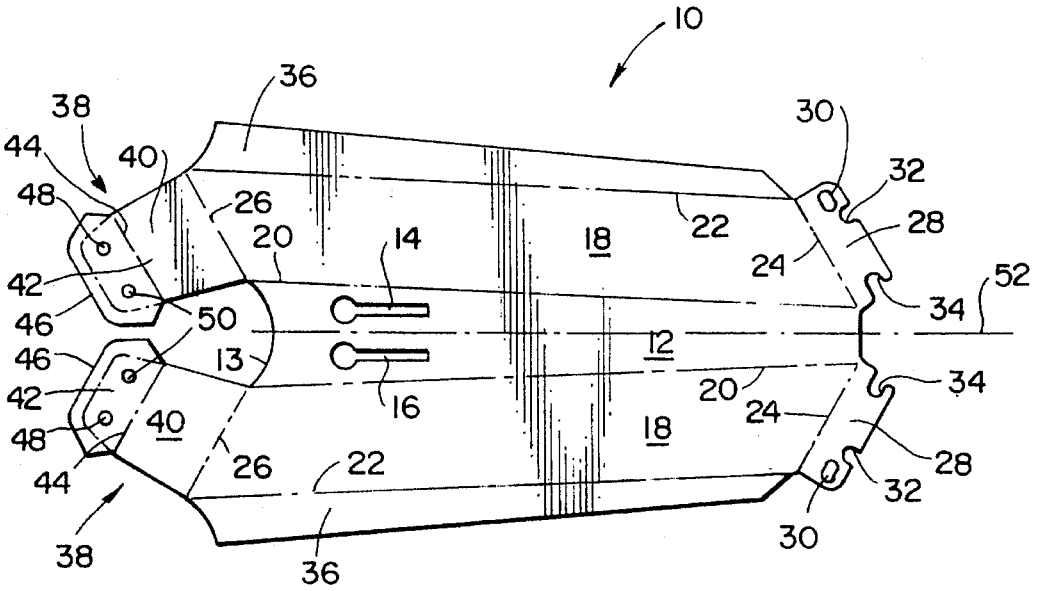
FIG. 1
FIG. 2
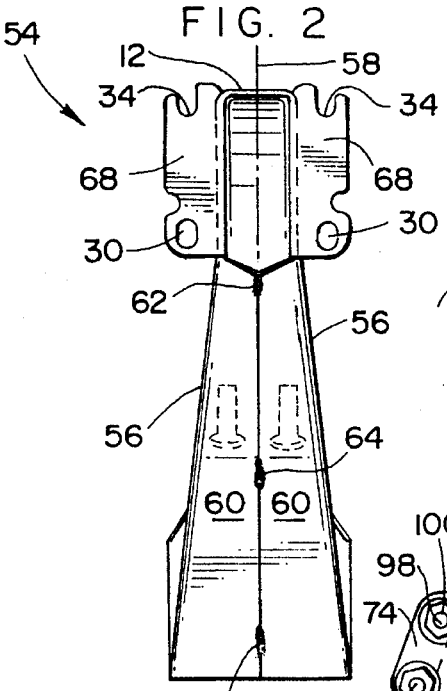
FIG. 5
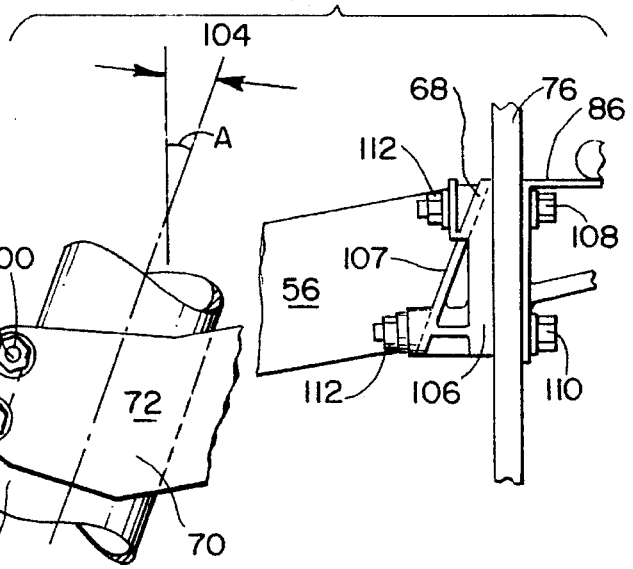

ONE-PIECE EXTENSION ARM

This application is a continuation of application Ser. No. 08/069,287, filed on May 28, 1993, now abandoned.

FIELD OF THE INVENTION

The invention relates to an extension arm for use in connecting a basketball backboard to a support pole.

BACKGROUND OF THE INVENTION

Basketball goal structures generally include a backboard, a rim attached to the backboard, an elongated support pole and a extension arm or bracket that secures the backboard to the support pole. Extension arms are normally comprised of multiple pieces that are welded together to form the extension arm in its final form. A multiple-piece extension arm is more costly and time consuming to assemble than a one-piece extension arm.

SUMMARY OF THE INVENTION

The invention provides for a one-piece extension arm or bracket for use in connecting a basketball backboard to a support pole. The extension arm includes a central web portion and a pair of legs extending downwardly from the web portion. A forward projection extends outwardly from the forward end of each of the legs. The forward projections are adapted to secure the extension arm to the backboard. A rearward projection extends outwardly from the rearward end of each of the legs. The rearward projections are adapted to secure the extension arm around the support pole. The one-piece extension arm is symmetrical about a plane that bisects and is perpendicular to the web portion.

The invention also provides for a planar blank from which the one-piece extension arm is formed. The blank is also symmetrical about a plane that bisects and is perpendicular to the web portion.

It is a feature of the invention that the extension arm is of one-piece construction.

It is another feature of the invention that the extension arm is composed of a minimum of parts while maintaining structural integrity.

It is another feature of the invention that the extension arm is symmetrical.

It is another feature of the invention that the extension arm is formed from a one-piece planar blank.

It is another feature of the invention that the planar blank is symmetrical.

Other features and advantages of the invention will become apparent to those of ordinary skill in the art upon review of the following drawings, detailed description and claims.

BRIEF DESCRIPTION OF THE DRAWINGS

FIG. 1 is a plan view of a planar blank of the invention;

FIG. 2 is a elevational view of the forward end of the extension arm formed from the planar blank;

FIG. 5 is a view similar to FIG. 4 showing the support pole of the basketball goal structure offset from vertical by 20 degrees.

Figure 3:
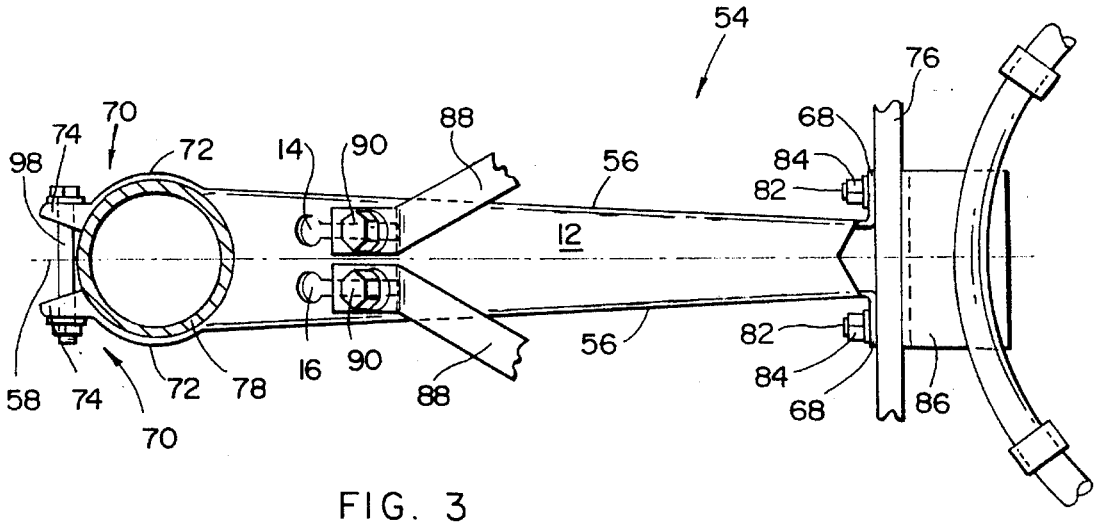
FIG. 3 is a plan view of a basketball goal structure of the invention which embodies the extension arm.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring to the drawings, a planar one-piece blank 10 embodying the invention is shown in FIG. 1. The blank 10 is the preformed stage from which the extension arm is made. The blank 10 is preferably cut from metal, however, the blank can also be cut from other materials. The blank 10 includes a central web portion 12 having a curved end 13 and having therein two apertures 14 and 16. On each side of the central web portion 12 is a leg portion 18. The pair of leg portions 18 are identical and have an inner side edge 20, an outer side edge 22, a forward end edge 24, and a rearward end edge 26. The side edges 20 and 22 and end edges 24 and 26 function as fold lines when the planar blank 10 is formed into the extension arm.

Continuing to refer to FIG. 1, extending outwardly from the end edge 26 or forward end of each leg portion 18 is a first end portion 28. The pair of first end portions 28 are identical and have therein an aperture 30 and two notches 32 and 34. The first end portions 28 enable the extension arm to be secured to a basketball backboard. Extending outwardly from the side edge 22 of each leg portion 18 is a flange portion 36. The pair of flange portions 36 are identical. Extending outwardly from the end edge 26 or rearward end of each leg portion 18 is a second end portion 38. The pair of second end portions 38 are identical and include an inner portion 40 adjacent the end edge 26 and a tab portion 42 extending outwardly from the inner portion 40. Separating the inner portion 40 from the tab portion 42 is a border line 44 that functions as a fold line when the blank 10 is formed into the extension arm. The tab portion 42 has a rounded outer edge 46 and has therein two apertures 48 and 50. The apertures 48 and 50 are adapted to secure the extension arm to a support pole.

The planar blank 10 is symmetrical about a longitudinal plane 52 that bisects and is perpendicular to the central web portion 12. The pair of first end portions 28 extend outwardly from the end edge 24 of the corresponding leg portions 18. The pair of second end portions 38 extend outwardly from the end edge 26 of the corresponding leg portions 18. The advantages of the planar blank 10 of the invention are that the blank 10 is easier and less costly to manufacture than multiple-pieces that are used in the formation of an extension arm.

Figure 4:
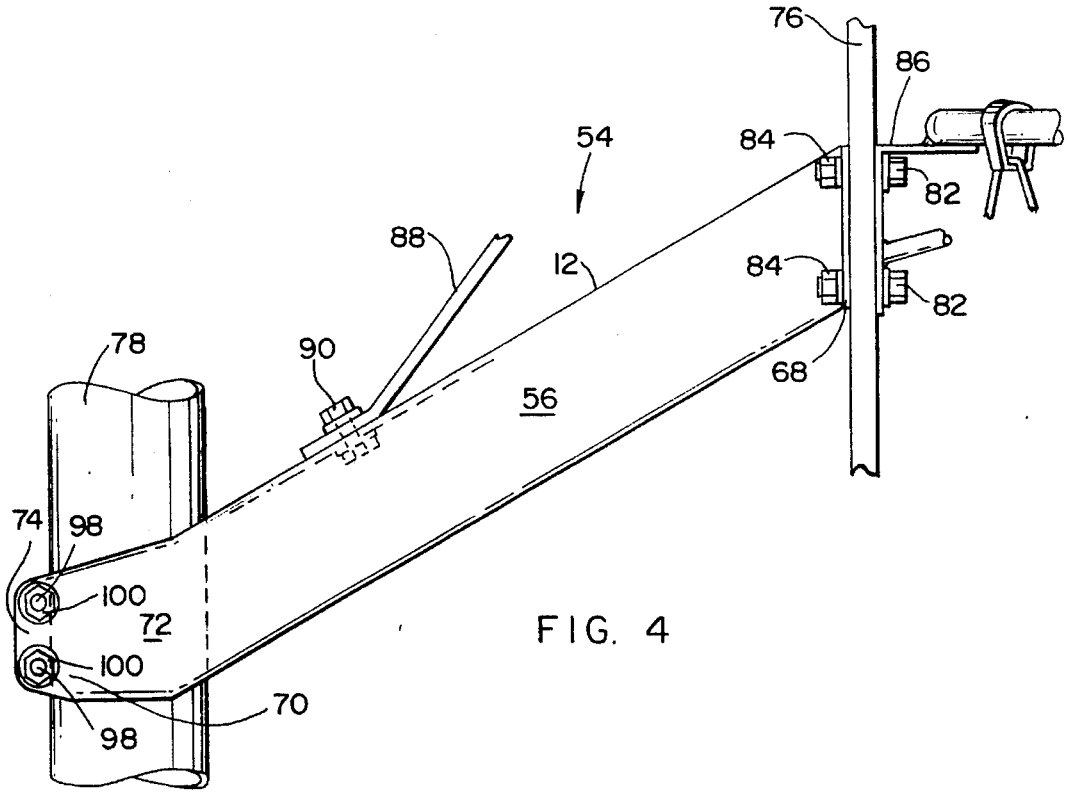
FIG. 4 is side elevational view of the basketball goal structure with a support pole in a vertical orientation.

An extension arm embodying the invention is formed from the one-piece planar blank 10 by folding the blank 10 using any conventional method. As shown in FIGS. 2–4, in its final formed stage, the one-piece extension arm 54 approximates a hollow elongated shape. In particular, the extension arm 54 is formed from the blank 10 as follows. As best shown in FIG. 2, the pair of leg portions 18 of the blank 10 are bent downwardly along the side edge 20 to form a pair of legs 56 of the extension arm 54. The legs 56 are at an angle of approximately a 90 degrees with respect to the central web portion 12. The flange portions 36 of the blank 10 are bent inwardly along the side edge 22 and toward each other to form flanges 60 of the extension arm 54. The flanges 60 are spot welded together at various points such as points 62, 64 and 66. It should be noted that the flanges 60 can be secured to one another by other methods.

Continuing to refer to FIG. 2, the first end portions 28 of the blank 10 are bent outwardly along the end edge 24 to form forward projections 68 of the extension arm 54. Each forward projection continues to have therein the aperture 30 and the notches 32 and 34 and each forward projection 68 forms an angle of approximately 90 degrees with respect to the corresponding leg 56. The pair of second end portions 38 of the blank 10 are bent along the end edges 26 to form rearward projections 70 of the extension arm 54 as follows with reference to FIG. 3. The inner portions 40 of each second end portion 38 of the blank 10 are bent to form curved portions 72 of each rearward projection 70. The pair of curved portions 72 have a radius of curvature that is slightly larger than the radius of curvature of the support pole to which it will later be attached. The tab portion 42 of each second end portion 38 of the blank 10 is bent along the fold line 44 to form a tab 74 on each rearward projection 70. As shown in FIGS. 2 and 3, after the extension arm 54 is formed from the planar blank 10, the extension arm 54 is symmetrical about a plane 58 that bisects and is perpendicular to the central web portion 12.

Referring to FIGS. 3 and 4, after the extension arm 54 has been formed from the blank 10, the extension arm 54 can then be used to connect a basketball backboard 76 to a support pole 78. To accomplish this, means for securing the forward projections to the backboard are utilized. Preferably, those means include a plurality of bolts 82 and nuts 84. Alternatively, the means may include other fasteners such as nails, screws, welds or the like. In the preferred embodiment, the forward projections are secured to the backboard 76 by sliding bolts 82 through apertures in the backboard 76, through the aperture 30 and the notch 34 in each forward projections 68, then securing the bolts 82 in place with nuts 84. Optionally and as shown in FIGS. 3 and 4, when attaching the extension arm 54 to the backboard 76, a rim 86 can also be secured to the backboard 76 with the same bolts 82 as follows. Before the bolts 82 are slid through apertures in the backboard 76, the rim 86 is placed next to the backboard 76. The bolts 82 are then slid through apertures in the rim 86, apertures in the backboard 76, and the aperture 30 and notch 34 in the forward projections 68 as previously described and then secured in place with nuts 84.

Continuing to refer to FIGS. 3 and 4, the extension arm 54 is preferably also secured to the backboard 76 using a pair of struts 88. The struts 88 are secured to the central web portion 12 of the extension arm 54 using the apertures 14 and 16 in the central web portion 12. Each strut 88 is secured to the central web portion 12 using bolts 90 that are positioned through the apertures 14 and 16 and secured using nuts (not shown). The other end of each strut 88 is secured to the backboard 76 using bolts and nuts (not shown).

The extension arm 54 is secured around the support pole 78 as follows. Referring to FIGS. 3 and 4, the pair of rearward projections 70 are slid onto the support pole 78 such that the curved portions 72 of each rearward projection 70 loosely surround the support pole 78 and the curved end 13 of the central web portion 12 is in close proximity to the support pole 78. The extension arm 54 with backboard 76 attached is positioned at a desired location along the support pole 78. To secure the extension arm 54 around the support pole 78 at the desired location, means for securing the rearward projections around the support pole are provided such as bolts 98 and nuts 100. Alternatively, the means may also include welding or other fasteners such as screws or the like. In the preferred embodiment, bolts 98 are slid through the apertures 48 and 50 in each of the tabs 74 and secured in place with nuts 100. In this secured position, the curved portions 72 of each rearward projection 70 are in tight engagement with the outer surface of the support pole 78.

In an alternative embodiment as depicted in FIG. 5, the support pole 102 is offset from a vertical axis 104. The offset from the vertical axis 104 is an angle A of approximately 20 degrees. It should be noted, however, that the angle A may be greater or smaller than 20 degrees. The attachment of the extension arm 54 to the support pole 102 in the alternate embodiment remains the same as described in the embodiment shown in FIGS. 3 and 4. However, due to the angle of the support pole 102, the forward projections 68 of the extension arm 54 need to be adapted before being attached to the backboard 76 to ensure that the backboard 76 remains in a vertical orientation and is not slanted. In the alternative embodiment, the means for securing the forward projections 68 to the backboard include wedges 106, bolts 108 and 110 and nuts 112. One wedge 106 is secured to each forward projection 68 and to the backboard 76 as follows with reference to FIG. 5. The wedge 106 slides onto the forward projection such that the forward projection is positioned behind the top plate 107 of the wedge 106. The wedge 106/forward projection 68 combination is then attached to the backboard with bolts 108 and 110. Bolt 108 slides through an aperture in the backboard 76 and then through wedge 106 and the notch 34 in the forward projection 68 and is secured with nut 112. Bolt 110 slides through an aperture in the backboard 76 and then through the wedge 106 and aperture 30 in the forward projection 68 and is secured with nut 112. In final assembled form, the extension arm 54 is secured to the backboard with two wedges 106, two bolts 108, two bolts 110 and four nuts 112.

If the angle A of the support pole 102 is altered from 20 degrees, the wedges 106 need to be appropriately altered such that when the forward projections 68 and wedges 106 are attached to the backboard 76, the backboard 76 remains in a vertical orientation.

Optionally and as shown in FIG. 5, when attaching the forward projections 68 to the backboard 76 using the wedges 106, bolts 108 and 110 and nuts 112, the rim 86 can also be secured to the backboard 76 with the same wedges 106, bolts 108 and 110, and nuts 112 as follows. Before the bolts 108 and 110 are slid through apertures in the backboard 76, the rim 86 is placed next to the backboard 76. The bolts 108 and 110 are then slid through apertures in the rim 86, apertures in the backboard 76, the wedges 106 and forward projections 68 as previously described and then secured in place with nuts 112.

Advantages of the invention are that the extension arm is composed of only one piece as opposed to multiple pieces that must be interconnected. A one-piece extension arm is less costly to manufacture and easier to assemble. The extension arm is also a stable bracket for connecting the backboard to the support pole that maintains its structural integrity with a minimum of parts.

I claim:

1. Basketball goal apparatus including a backboard for supporting a rim, a support pole having an outer periphery, and a one-piece extension arm formed of a unitary material for connecting the backboard to a support pole, said one-piece extension arm comprising:

a central web;

a pair of spaced legs depending from and formed integrally with said web portion;

at least one forward projection having means for connecting the arm to the backboard, said forward projection depending from and formed integrally with said unitary material; and a first rearward projection for connecting the arm to the support pole, said rearward projection depending from and formed integrally with one of said legs, and being shaped to correspond to at least a portion of the outer periphery of the support pole and yieldable to cooperate with the other of said legs to clamp the extension arm to the support pole.

2. The apparatus of claim 1 further comprising a second rearward projection for connecting the arm to the support pole, said second rearward projection depending from and formed integrally with the other of said legs, said first projection cooperating with said second projection to clamp the extension arm to the support pole.

3. The apparatus of claim 2 wherein said rearward projections each include a curved portion and a tab portion extending integrally and outwardly from said curved portion, said curved portions having a radius of curvature slightly greater than the radius of curvature of the support pole.

4. The apparatus of claim 3 wherein the outer periphery of said support pole is cylindrical, said central web includes a curved portion shaped to correspond to at least a part of the outer periphery of the support pole, and said tab portions of rearward projections each have at least one aperture adapted to receive at least one substantially straight bolt for deflecting said rearward projections inwardly to securely retain the pole between said curved portions of said legs and said curved portion of said web.

5. The apparatus of claim 1 wherein said at least one forward projection comprises a pair of projections depending from said legs, each projection having at least one aperture or notch.

6. The apparatus of claim 1 further including a basketball rim and wherein said connecting means also attaches the rim to the backboard.

7. The apparatus of claim 1 wherein said one-piece extension arm is formed from a substantially planar blank of said unitary material in which said legs are bent relative to the central web to produce a folded body having a generally U-shaped cross section, said at least one forward projection being bent until it occupies an angled position relative to a longitudinal axis of the extension arm, and said first rearward projection being bent into a shape corresponding to at least a first portion of the outer periphery of the support pole.

8. The apparatus of claim 7 further comprising a second rearward projection for connecting the arm to the support pole, said second rearward projection depending from and formed integrally with the other of said legs, and being bent into a shape corresponding to at least a second portion of the periphery of the support pole.

9. The apparatus of claim 8 wherein the outer periphery of said support pole is cylindrical, said first and second rearward projections have curved shapes, and said substantially planar blank includes a curved portion shaped to correspond to at least a third portion of the outer periphery of the support pole.

10. The apparatus of claim 7 wherein said one-piece extension arm further includes at least one flange depending from and integrally formed with one of said legs, said flange being substantially co-planar with said one leg when the arm is in a preformed stage and being angled relative to the legs after the arm is formed such that the formed arm has a substantially closed, cross section.

11. The apparatus of claim 10 wherein said at least one flange comprises a pair of flanges, each formed integrally with and depending from one of the legs such that said web portion, said legs and said flanges form a hollow, elongated shape in the formed stage.

12. The apparatus of claim 11 wherein said flanges are at least partly joined together in the formed stage.

13. The apparatus of claim 10 wherein said extension arm is symmetrical about a plane that bisects and is perpendicular to the central web in both the preformed and formed stages.

14. The apparatus of claim 1 wherein said support pole has a longitudinal axis offset from vertical.

15. The apparatus of claim 14 wherein the support pole is offset from vertical by an angle of approximately 20°.

16. The apparatus of claim 14 wherein said means for connecting the arm to the backboard includes at least one wedge disposed between the backboard and said at least one forward projection.

17. The apparatus of claim 2 wherein said one-piece extension arm extends between the support pole and the backboard and is the sole member connecting the backboard to the support pole.

18. The apparatus of claim 17 further comprising at least one strut connected to and extending between said extension arm and said backboard.

19. The apparatus of claim 18 wherein said rearward projections directly abut the outer periphery of the support pole.

20. Basketball goal apparatus comprising a basketball backboard, a support pole, a bracket formed of a unitary material having an elongated web, a pair of spaced legs formed integrally with and connected to said elongated web, means formed integrally with one end of said bracket for attaching said bracket to the backboard, and means formed integrally with the opposite end of said bracket for securing said bracket to the support pole, said bracket having a substantially planar, preformed stage and a non-planar, formed stage in which said legs, said attaching means, and said securing means are angled relative to said web.

* * * * *